US012398706B2

(12) United States Patent
Rosinski

(10) Patent No.: US 12,398,706 B2
(45) Date of Patent: Aug. 26, 2025

(54) BALL PISTON PUMP

(71) Applicant: GHSP, Inc., Holland, MI (US)

(72) Inventor: Ryan David Rosinski, Whitehall, MI (US)

(73) Assignee: GHSP, Inc., Holland, MI (US)

( * ) Notice: Subject to any disclaimer, the term of this patent is extended or adjusted under 35 U.S.C. 154(b) by 542 days.

(21) Appl. No.: 17/780,092

(22) PCT Filed: Dec. 2, 2020

(86) PCT No.: PCT/IB2020/061406

§ 371 (c)(1),
(2) Date: May 26, 2022

(87) PCT Pub. No.: WO2021/116835

PCT Pub. Date: Jun. 17, 2021

(65) Prior Publication Data

US 2022/0412330 A1 Dec. 29, 2022

Related U.S. Application Data

(60) Provisional application No. 62/946,004, filed on Dec. 10, 2019.

(51) Int. Cl.

| | |
|---|---|
| ***F04B 1/1071*** | (2020.01) |
| ***F04B 7/06*** | (2006.01) |
| ***F04B 53/10*** | (2006.01) |

(52) U.S. Cl.

CPC ..... *F04B 1/1071* (2013.01); *F04B 7/06* (2013.01); *F04B 53/10* (2013.01)

(58) Field of Classification Search

CPC ..... F04B 1/1071; F04B 7/06; F04B 53/10; F04B 1/10; F04B 1/113; F04B 1/1133; F04B 11/00

See application file for complete search history.

(56) References Cited

U.S. PATENT DOCUMENTS 2,391,221 A * 12/1945 Beeh ..... F02M 69/02 137/565.28

3,782,245 A 1/1974 Aldinger (Continued)

FOREIGN PATENT DOCUMENTS

JP 861222 A 3/1996
JP 2011111980 A 6/2011

(Continued)

*Primary Examiner* — Philip E Stimpert
(74) *Attorney, Agent, or Firm* — Price Heneveld LLP

(57) ABSTRACT

A fluid pump includes a cam plate that defines an interior cam surface having an eccentric portion and a narrow portion. A hub rotates within the interior cam surface and has a piston cavity that is in communication with an inlet port and an outlet port. A piston member is operably received within the piston cavity to define a suction phase within the eccentric portion and a pressure phase within the narrowed portion. The piston member is biased outward by rotational operation of the hub. During the suction phase, the piston member is biased away from the piston cavity to define a flow cavity that draws fluid from the inlet port. During the pressure phase, the piston member is biased by the narrowed portion into the flow cavity to push the fluid from the flow cavity toward the outlet port.

20 Claims, 9 Drawing Sheets

(56) References Cited

U.S. PATENT DOCUMENTS

| | | | | | |
|---|---|---|---|---|---|
| 3,835,752 | A | | 9/1974 | D'Amata | |
| 3,999,466 | A | * | 12/1976 | Aschke | F04B 1/2042 91/499 |
| 4,352,319 | A | * | 10/1982 | Wegerdt | F04B 1/066 91/483 |
| 2013/0343914 | A1 | * | 12/2013 | Fenny | F04B 1/0404 417/273 |

FOREIGN PATENT DOCUMENTS

| | | | | | |
|---|---|---|---|---|---|
| KR | 101176638 | | | 8/2012 | |
| WO | WO-2017089586 | A1 | * | 6/2017 | F04B 1/04 |

* cited by examiner

BALL PISTON PUMP

FIELD OF THE INVENTION

The present invention generally relates to fluid pumps, and more specifically to a fluid pump having one or more piston members that operate to move fluid through a rotating hub.

BACKGROUND OF THE INVENTION

Various pumps are used to move a fluid from one location to another. These fluid pumps operate by using changes in pressure to generate suction and pressure that moves fluid from an inlet to an outlet.

SUMMARY OF THE INVENTION

According to one aspect of the present invention, a fluid pump includes a cam plate that defines an interior cam surface having an eccentric portion and a narrow portion. A hub rotates within the interior cam surface and has a piston cavity that is in communication with an inlet port and an outlet port. A piston member is operably received within the piston cavity to define a suction phase within the eccentric portion and a pressure phase within the narrowed portion. The piston member is biased outward by rotational operation of the hub. During the suction phase, the piston member is biased away from the piston cavity to define a flow cavity that draws fluid from the inlet port. During the pressure phase, the piston member is biased by the narrowed portion into the flow cavity to push the fluid from the flow cavity toward the outlet port.

According to another aspect of the present invention, a fluid pump includes a cam plate having an interior cam surface that defines alternating eccentric and narrowed sections. A hub rotates within the interior cam surface and includes piston cavities in communication with an inlet port and an outlet port. Piston members are respectively positioned within the piston cavities to define flow cavities therebetween. Rotation of the hub generates a centrifugal force that biases the piston members toward the interior cam surface and away from a rotational axis of the hub. The alternating eccentric and narrowed sections define respective suction and pressure phases of each piston member. Each suction phase biases the piston members outward to expand the flow cavity. The suction phases draw a fluid into the flow cavity from the inlet port. Each pressure phase biases the piston members into the respective piston cavities to compress the flow cavity and expel the fluid from the flow cavity and toward the outlet port. The inlet port is aligned with the eccentric sections and the outlet port is aligned with the narrowed sections.

According to another aspect of the present invention, a fluid pump includes an end assembly having a fluid inlet and a fluid outlet. A fluid path extends between the fluid inlet and the fluid outlet. The fluid path has centrifugal sections and centripetal sections that move fluid through the fluid path. A cam plate includes an interior cam surface that defines the centrifugal sections and the centripetal sections. A hub assembly rotates about a rotational axis. The hub assembly comprises a plurality of piston members and a central hub. Rotation of the hub assembly through the centrifugal sections and the centripetal sections defines a radial movement of each piston member. The plurality of piston members operate in a radially outward direction in the centrifugal sections to expand corresponding flow cavities that draw the fluid from an inlet port. The plurality of piston members operating in a radially inward direction in the centripetal sections to compress the flow cavities and push the fluid out of the flow cavity and toward an outlet port.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 2:
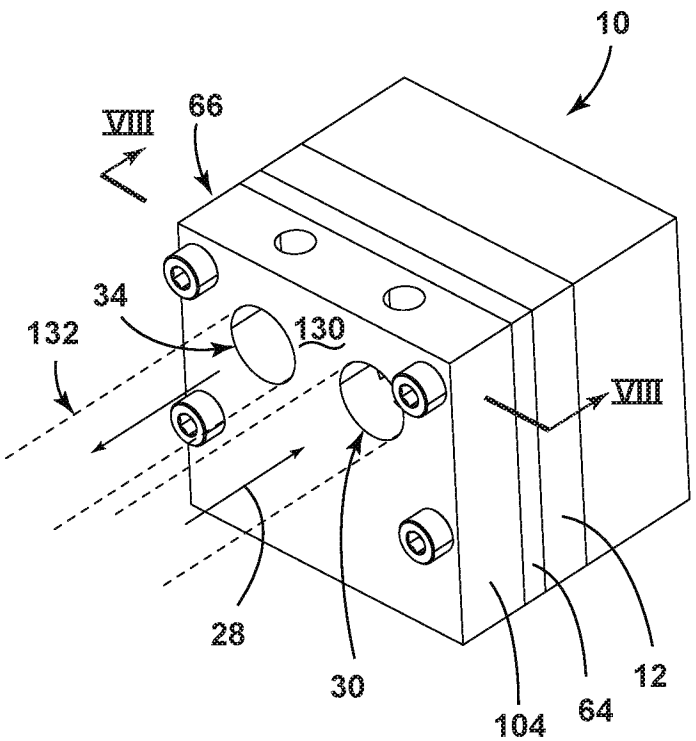
FIG. 2 is another side perspective view of the ball piston pump of FIG. 1.
Figure 1:
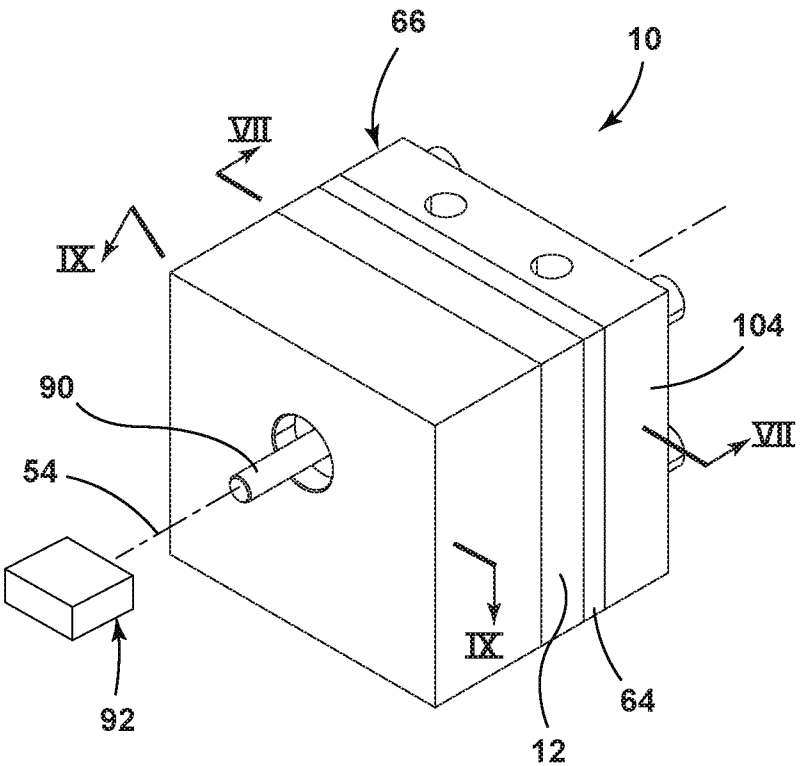
FIG. 1 is a side perspective view of an aspect of a ball piston pump.
Figure 4:
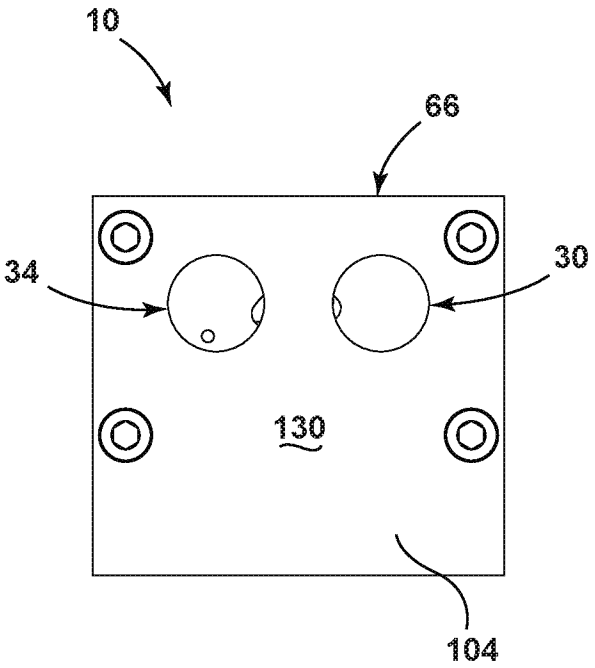
FIG. 4 is a side elevational view of the ball piston pump of FIG. 2.
Figure 3:
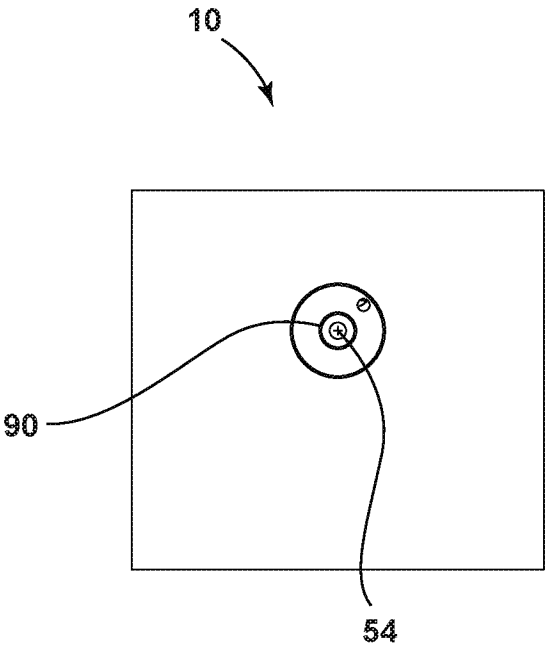
FIG. 3 is a side elevational view of the ball piston pump of FIG. 1.
Figure 5:
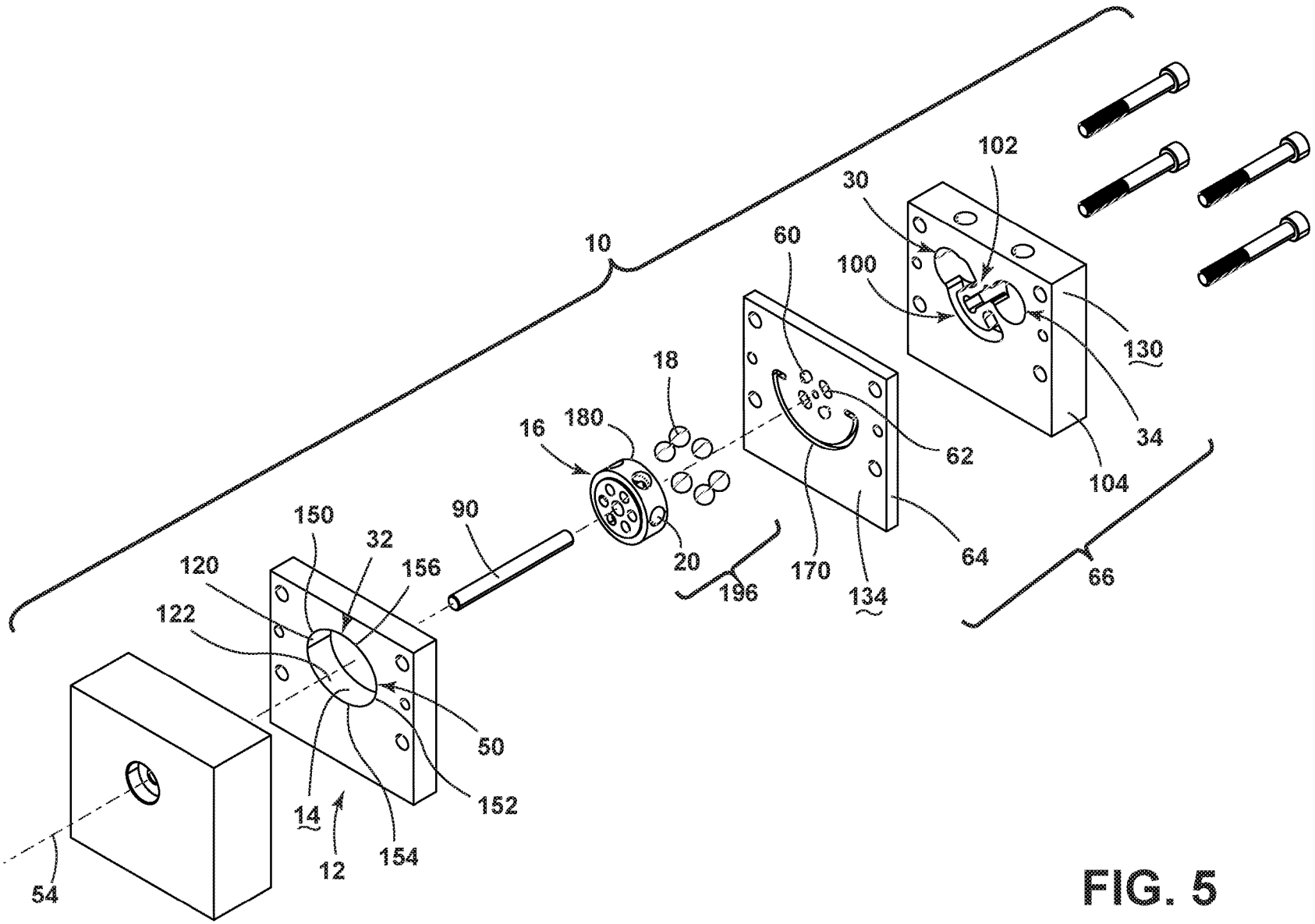
FIG. 5 is an exploded perspective view of the ball piston pump of FIG. 1.
Figure 6:
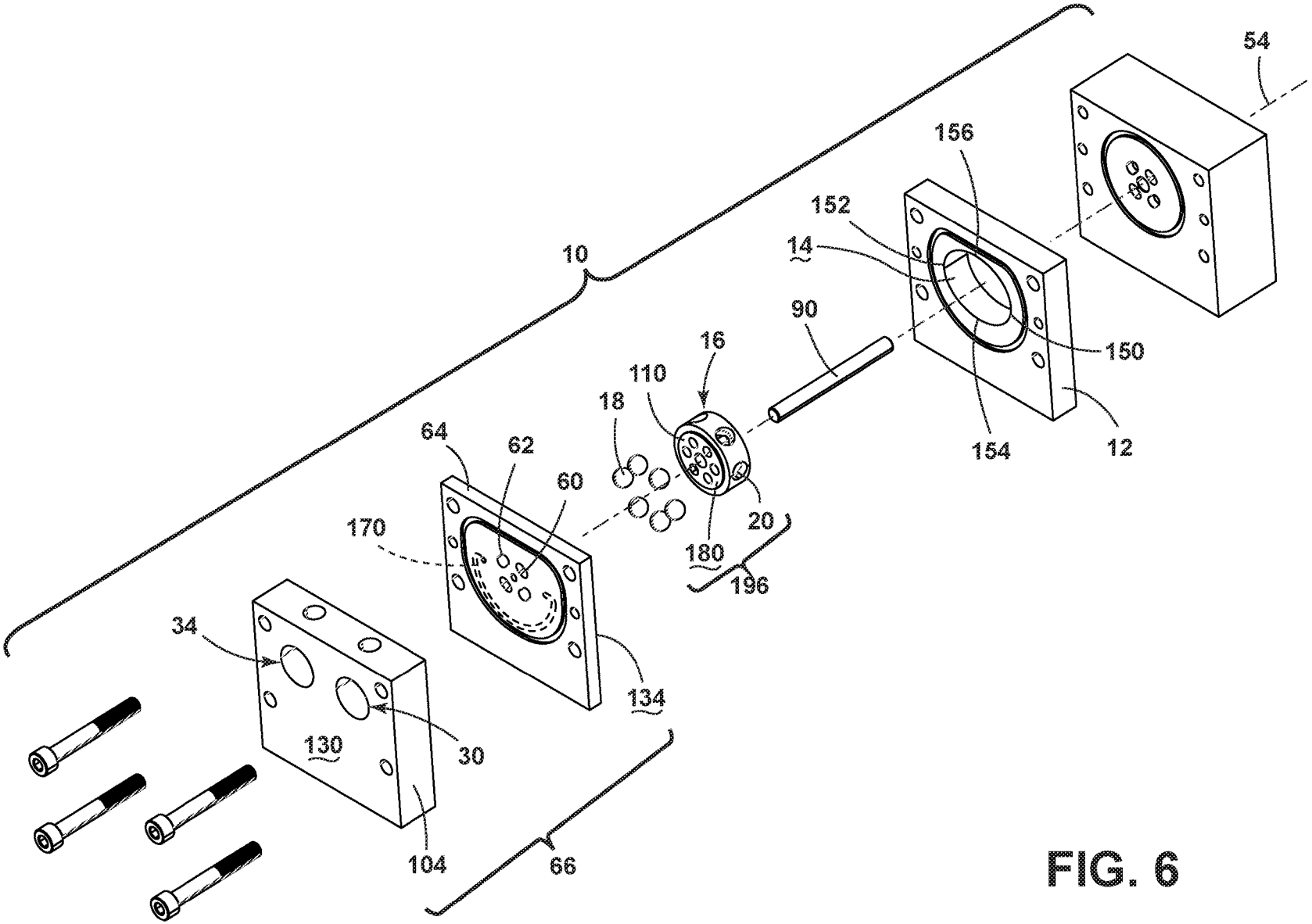
FIG. 6 is another exploded perspective view of the ball piston pump of FIG. 1.
Figure 7:
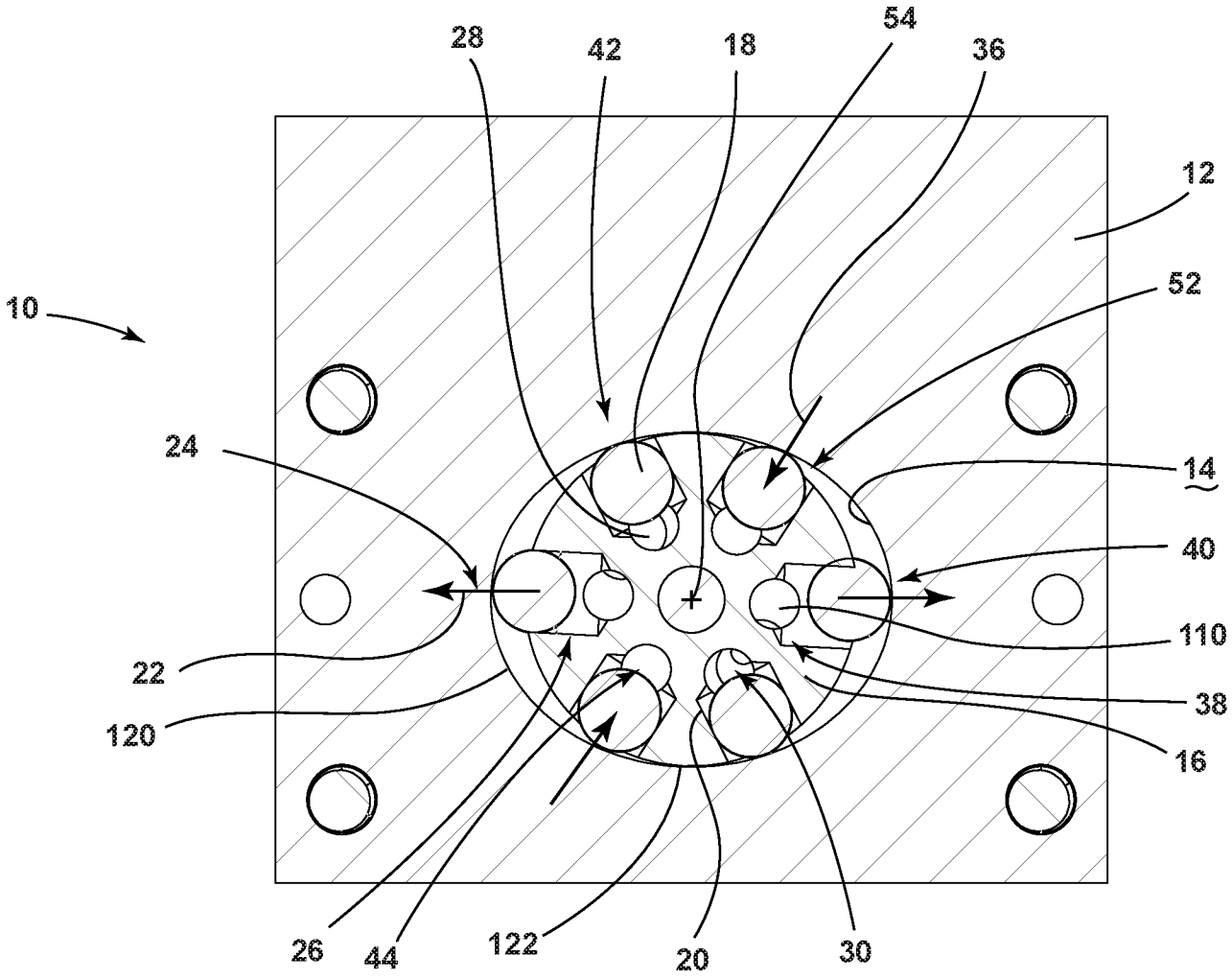
FIG. 7 is a cross-sectional view of the ball piston pump of FIG. 1 taken along line VII-VII.
Figure 8:
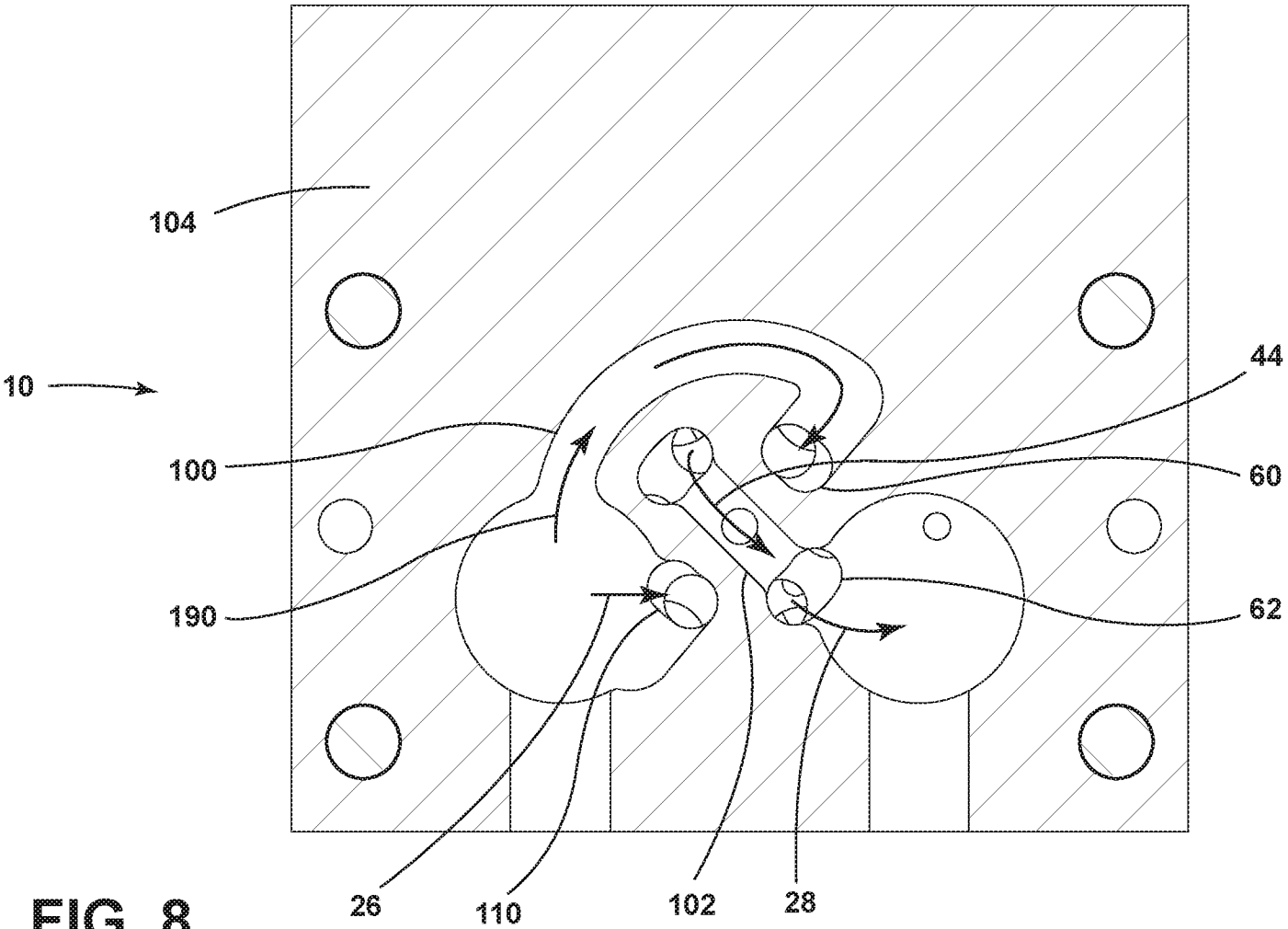
FIG. 8 is a cross-sectional view of the ball piston pump of FIG. 2 taken along line VIII-VIII.
Figure 9:
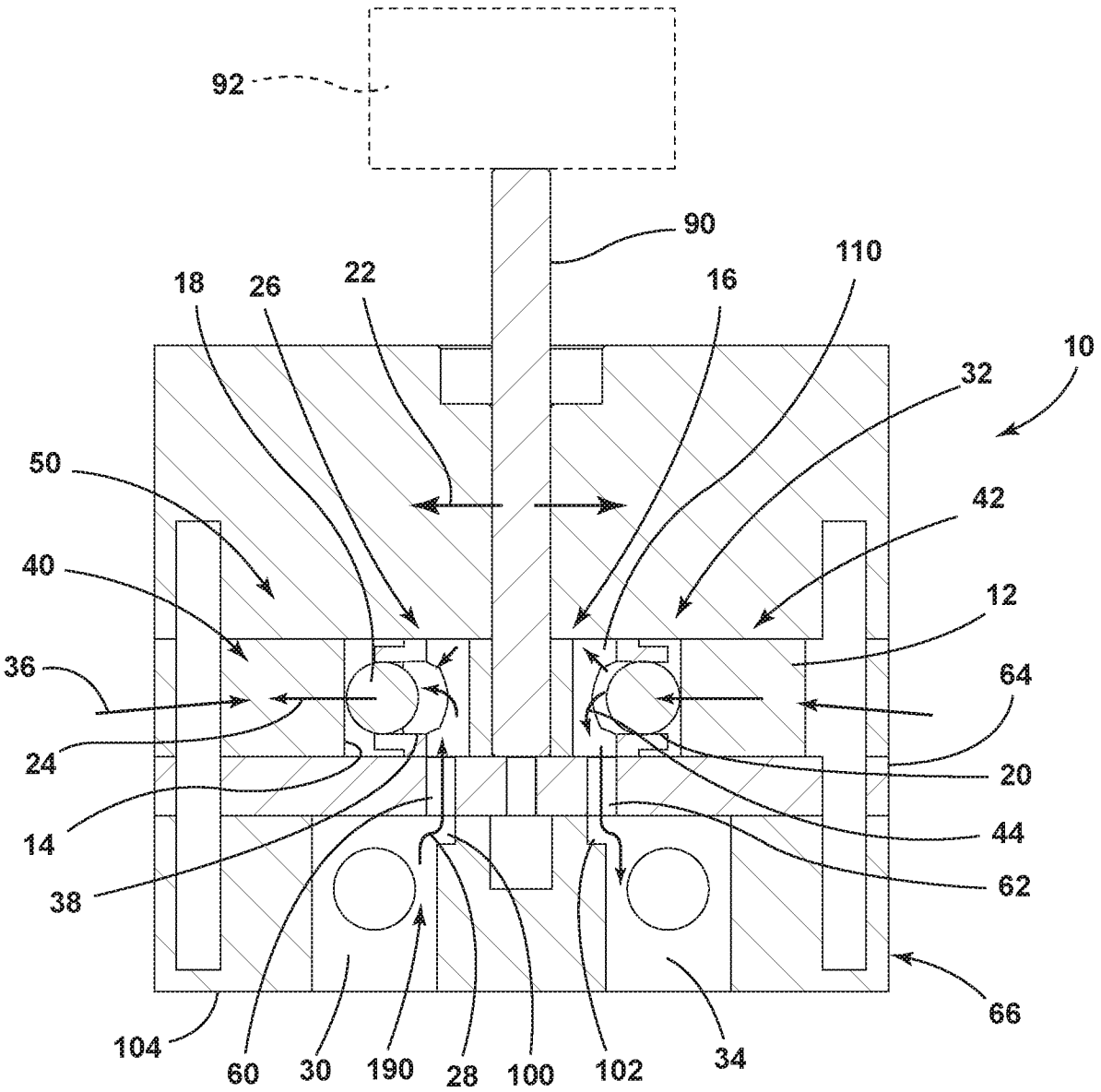
FIG. 9 is a cross-sectional view of the ball piston pump of FIG. 1 taken along line IX-IX.
Figure 10:
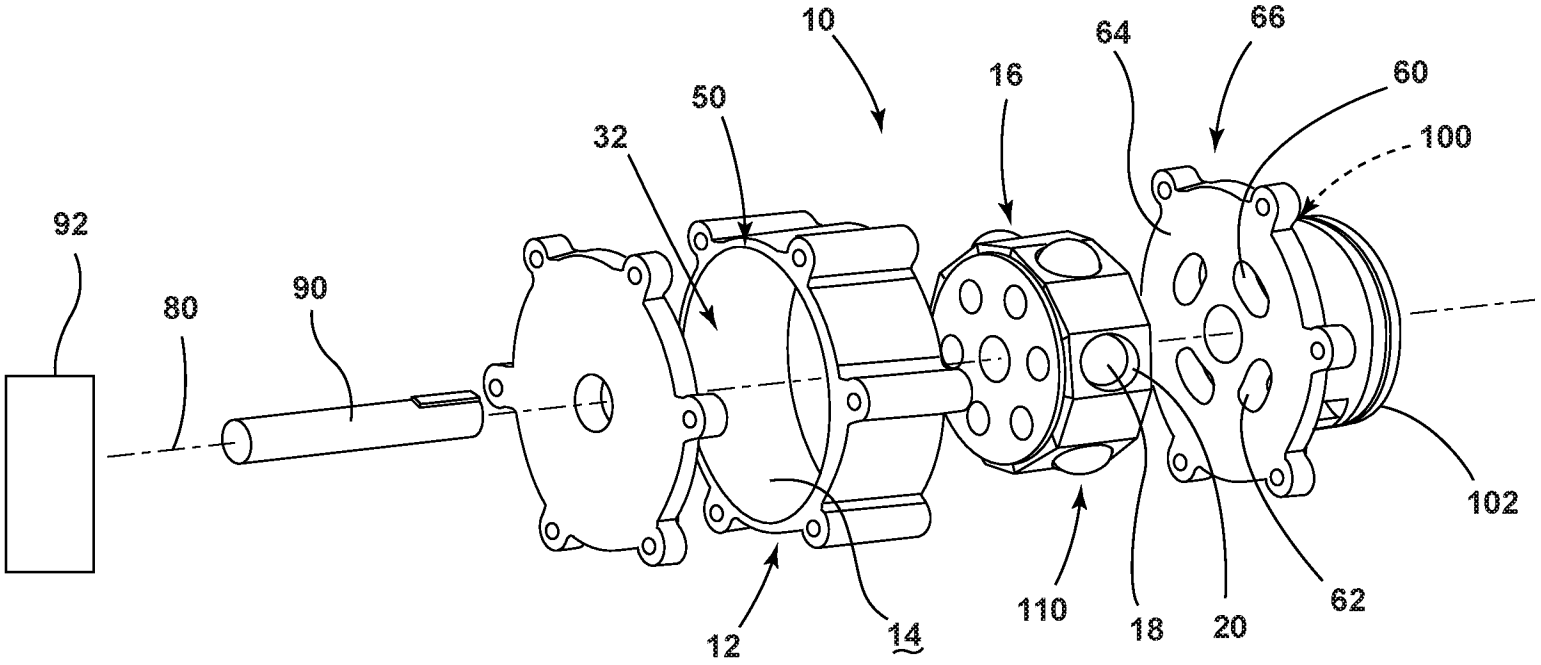
FIG. 10 is an exploded perspective view of an aspect of a ball piston pump.
Figure 11:
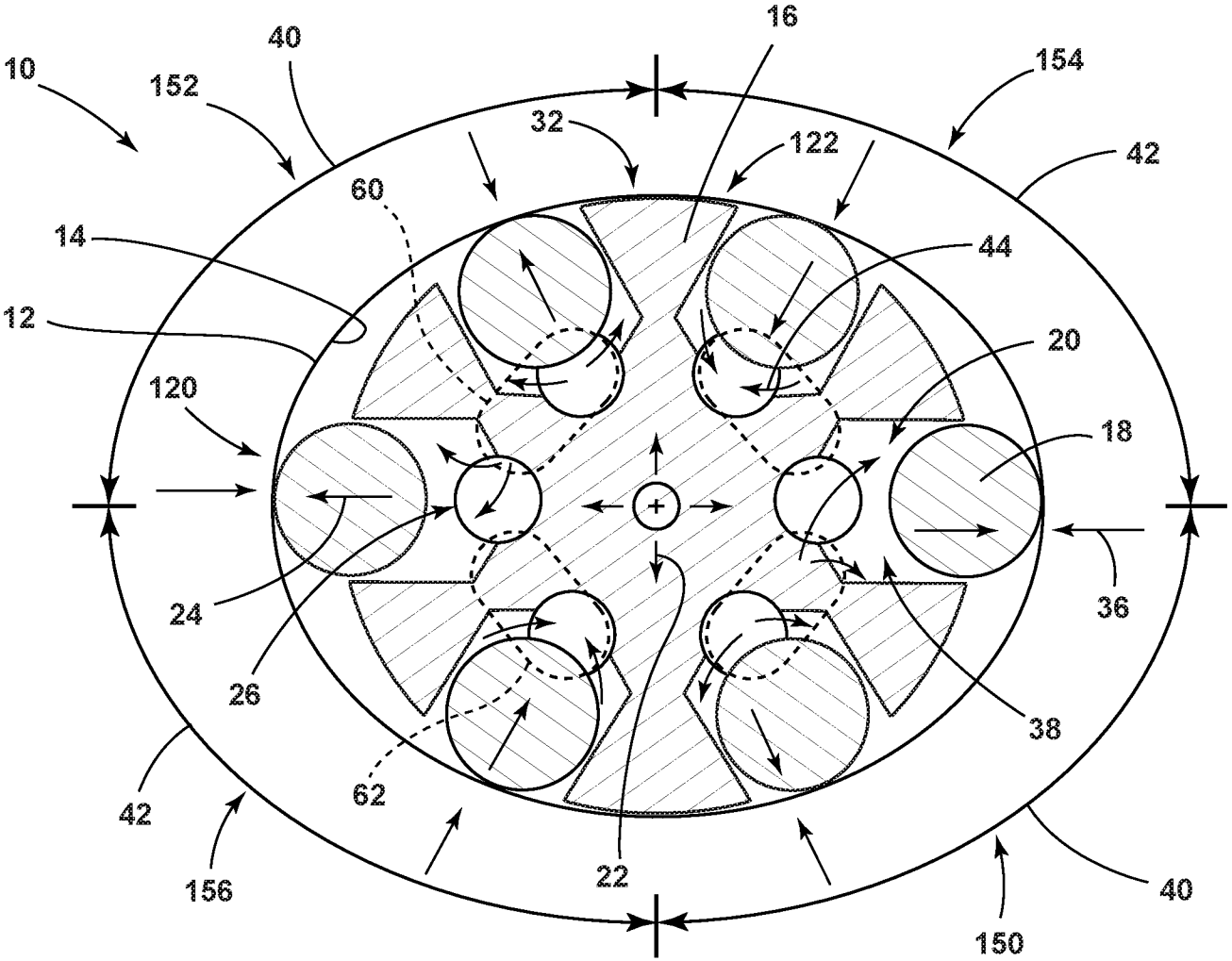
FIG. 11 is a schematic cross-sectional view of an aspect of the hub and the interior cam surface.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-11, reference numeral 10 generally refers to a ball piston pump having a cam member 12 that includes an interior cam surface 14 that cooperates with a rotating hub 16 having a plurality of piston members 18. The piston members 18 are paired within various apertures, such as piston cavities 20, defined within the hub 16. As the hub 16 rotates within the interior cam surface 14, centrifugal force 22 caused by rotation of the hub 16 within the cam member 12 causes a biasing force that moves the piston member 18 in an outward direction 24 and outside of the piston cavities 20. When the piston member 18 moves outside of the piston cavities 20, a suction 26 is generated that draws fluid 28 in through one or more inlet ports 60 and into the piston cavities 20, where a flow cavity 38 is defined between the piston members 18 and the flow cavities 38. As the hub 16 rotates, the piston member 18 and piston cavities 20 become aligned with a narrowed portion 32 of the interior cam surface 14, such that the interior cam surface 14 biases, through a centripetal force 36, the piston member 18 into the piston cavities 20. This movement of the piston member 18 into the piston cavities 20, where the piston member 18 now occupy the piston cavities 20, shrinks the flow cavity 38. In this manner, the movement of the piston member 18 pushes the piston member 18 into the piston cavity 20 and, in turn, pushes the fluid 28 out from the piston cavities 20 and into one or more corresponding outlet ports 62.

Referring again to FIGS. 4-11, the rotational operation of the hub 16 and the piston members 18 within the interior cam surface 14 generates a consistent centrifugal force 22 that is applied to the piston member 18. The centrifugal force 22 biases the piston member 18 away from the piston cavities 20. Simultaneously, the interior cam surface 14 generates an opposing centripetal force 36. Through these opposing centrifugal and centripetal forces 22, 36, the motion of the piston member 18 follows the path defined by the interior cam surface 14. As discussed above, the piston members 18 are permitted to move outside of the piston cavities 20 in an eccentric portion 50 or expanded portion of the interior cam surface 14. In this suction phase 40, the flow cavities 38 between the piston member 18 and the corresponding piston cavity 20 expand to generate suction 26. This suction 26 draws fluid into the flow cavities 38. As the hub 16 rotates with respect to the interior cam surface 14, the piston member 18 reach the narrowed portion 32 of the interior cam surface 14. Movement of the piston member 18 and the piston cavity 20 through the narrowed portion 32 defines a pressure phase 42 where the piston member 18 is biased through centripetal force 36 and into the piston cavity 20. This movement of the piston member 18 into the piston cavity 20 pushes the piston member 18 into the flow cavity 38 to generate a pressure 44 that pushes the fluid from the flow cavity 38 toward a fluid outlet 34.

The centrifugal force 22 that biases the piston member 18 in an outward direction 24, is counteracted by the centripetal force 36 that is generated by the interior cam surface 14. The eccentric portion 50 allows for a controlled movement of the piston member 18 in the outward direction. Conversely, the centripetal force 36 generated in the narrowed portion 32 overcomes the centrifugal force 22 and biases the piston member 18 back into the piston cavities 20. Accordingly, rotational motion of the hub 16 within the interior cam surface 14 generates an oscillating motion 52 of each piston member 18 with respect to a corresponding piston cavity 20. In operation, as the hub 16 rotates about the rotational axis 54 of the hub 16, the piston member 18 follows the path defined by the interior cam surface 14.

As exemplified herein, the interior cam surface 14 can include a generally elliptical profile having opposing eccentric portions 50 and opposing narrowed portions 32. These eccentric and narrowed portions 50, 32 generate a generally elliptical motion of the piston members 18 with respect to the interior cam surface 14. This, in turn, generates the oscillating motion 52 of each piston member 18 with respect to a corresponding piston cavity 20. Modifications in the shape of the interior cam surface 14 can be used to create a variety of patterns of eccentric portions 50 and narrowed portions 32 for managing a flow of the fluid 28 through the piston pump 10.

The shape of the interior cam surface 14 is aligned with corresponding inlet ports 60 and outlet ports 62 that are positioned within a port portion 64, such as a porting plate, of an end assembly 66 for the piston pump 10. Typically, the inlet ports 60 are aligned with the eccentric portions 50 of the interior cam surface 14. Conversely, the outlet ports 62 within the port portion 64 of the end assembly 66 are aligned with the narrowed portions 32 of the interior cam surface 14. In this manner, the oscillating motion 52 of the piston member 18 with respect to the piston cavities 20, and the corresponding expansion and compression of the flow cavities 38, is contemporaneous with the motion of each piston member 18 between the outlet port 62 positioned at the narrowed portion 32 and inlet port 60 positioned at the eccentric portion 50 of the interior cam surface 14.

The design of the hub 16 having the piston member 18 and piston cavities 20 set therein, and which rotates within the interior cam surface 14, is useful in moving fluids 28 having higher viscosities. Fluids 28 having higher viscosity may include generally thicker fluids 28, or fluids 28 that are thicker when at a lower temperature. By way of example, at a startup condition of a vehicle, a particular fluid 28 may have a higher viscosity. Operation of the piston pump 10 disclosed herein is useful in moving these higher viscosity fluids 28 through the piston pump 10. Additionally, as the viscosity of a particular fluid 28 decreases, the fluid 28 typically warms, and the piston pump 10 remains efficient at moving fluid 28 through the ball piston pump 10.

The shape of the interior cam surface 14 can be any one of various shapes that can include, but are not limited to, ovals, rounded geometries, or other similar rounded geometries having multiple axes of symmetry. As discussed above, these various geometries of the interior cam surface 14 are shaped to include various eccentric portions 50 and narrowed portions 32 that align with the inlet ports 60 and outlet ports 62, respectively. In certain aspects of the device, the interior cam surface 14 can take the shape of an egg-shaped geometry, where the egg-shaped geometry includes a single eccentric portion 50 and a single narrowed portion 32 with respect to a rotational axis 54 of the hub 16. This egg-shaped geometry of the interior cam surface 14 defines a single-fill fluid pump having a single inlet port 60 and a single outlet port 62. Typically, the interior cam surface 14 will include a geometry having a multiple axis of symmetry such that a dual-fill or multiple-fill configuration is possible. The dual-fill or multiple-fill configuration, such as a generally elliptical profile, typically provides an equalized pressure 44 around the rotational axis 54 such that the fluid apertures 110 of the piston cavities 20 are balanced around the rotational axis 54 of the hub 16 and within the interior cam surface 14. This cam member 12 tends to maintain an alignment of the hub 16 with the rotational axis 54 of the ball piston pump 10.

According to aspects of the device, the hub 16 can include various numbers of piston members 18 and piston cavities 20. As exemplified herein, six piston members 18 can be operable within six piston cavities 20. It should be contemplated that additional or fewer numbers of piston members 18 and piston cavities 20 can be incorporated into the hub 16. By way of example and not limitation, certain sized piston members 18 may be incorporated to produce a flow of a more viscous fluid. Different sizes and configurations of piston members 18 can be incorporated to address the flow of fluids having different viscosities and variable viscosities over time. In addition, the number and shape of the narrowed and eccentric portions 32, 50 of the interior cam surface 14 can be modified to account for fluids having different viscosities. Variations in the number and configuration of the piston members 18, the piston cavities 20 and the interior cam surface 14 can also be used to address a wide range of piston pumps 10 for producing a variety of flow rates.

According to various aspects of the device, a drive shaft 90 of the piston pump 10 can extend from a motor 92 to the hub 16. As the motor 92 operates, the drive shaft 90 rotates the hub 16 within the interior cam surface 14. The motor 92 can typically operate at speeds of approximately 4,000 revolutions per minute or lower speeds where the fluid 28 has a higher viscosity or where a lower flow rate is desired. Where the fluid 28 has a lower viscosity or a higher flow rate is desired, higher rotational speeds can be utilized. Higher rotational speeds may be approximately 10,000 revolutions per minute. It should be understood that the motor 92 and the hub 16 can operate at a wide range of rotational speeds greater than or less than those mentioned herein. The rotational speed utilized is typically calibrated to generate the centrifugal force 22 on the piston member 18 of a magnitude sufficient to produce a continual engagement of the piston members 18 with the interior cam surface 14.

The piston pump 10 disclosed herein can be used for applications having higher viscous fluids 28 or fluids 28 that are more viscous at cooler temperatures. Such applications can include, but are not limited to, vehicle transmissions, vehicle differentials and other similar applications where higher viscosity fluids 28 are utilized, and where the fluid 28 has a higher viscosity at lower temperatures seen at a start-up of a particular mechanism.

As exemplified in FIGS. 4-11, the various inlet ports 60 and outlet ports 62 contained within the port portion 64 of the end assembly 66 can be configured to extend to a common inlet channel 100 and a common outlet channel 102, respectively. In such a configuration, an end plate 104 of the end assembly 66 can include a fluid inlet channel 100 that extends between each of the inlet ports 60 of the port portion 64 of the end assembly 66. Similarly, a fluid outlet channel 102 can include a path that extends between the various fluid outlet ports 62 of the port portion 64 of the end assembly 66. Using the fluid inlet and fluid outlet channels 100, 102, a single inlet path and a single outlet path can be defined within the end assembly 66 of the piston pump 10.

Referring again to FIGS. 4-11, the hub 16 can include the various piston cavities 20 that receive the piston members 18 that operate in an oscillating motion 52 with respect to the interior cam surface 14 as oscillating members. These piston members 18 can be in the form of balls, cylinders, or other geometries that can be used to operate in an oscillating motion 52 or piston-type fashion with respect to the piston cavities 20 defined within the hub 16.

Referring again to FIGS. 1-11, the fluid delivering piston pump 10 can include the cam member 12, such as a cam plate having the interior cam surface 14 that defines eccentric and narrowed portions 50, 32. These eccentric and narrowed portions 50, 32 can be configured as alternating eccentric and narrowed sections 120, 122 such that multiple eccentric and narrowed sections 120, 122 can be included within the eccentric and narrowed portions 50, 32. The hub 16 rotates within the interior cam surface 14 and includes piston cavities 20 in communication with the inlet port 60 and the outlet port 62. The piston members 18, typically in the form of the ball piston, are respectively positioned within the piston cavities 20 to define flow cavities 38 therebetween.

Rotation of the hub 16 generates the centrifugal force 22 that biases the piston member 18 toward the interior cam surface 14 and away from the rotational axis 54 of the hub 16. The alternating eccentric and narrowed sections 120, 122 define respective suction and pressure phases 40, 42 of each piston member 18. Each suction phase 40 biases the piston member 18 outward to expand the respective flow cavity 38. The suction phases 40 serve to draw the fluid 28 into the flow cavity 38 from the inlet port 60. Accordingly, the expansion of the flow cavity 38 generates the suction 26 that draws the fluid 28 into the flow cavity 38. Each pressure phase 42 biases the piston member 18 back into the respective piston cavities 20 to compress the flow cavity 38. This compression of the flow cavity 38 generates pressure 44 that serves to expel the fluid 28 from the flow cavity 38 and move the fluid 28 toward the outlet port 62. The inlet port 60 is aligned with the eccentric sections 120 and the outlet port 62 is aligned with the narrowed sections 122. According to various aspects of the device, each eccentric section 120 can include a corresponding inlet port 60 and each narrowed section 122 can include a corresponding outlet port 62.

Referring to FIGS. 4-11, the inlet port 60 and the outlet port 62 are defined within the end assembly. Typically, the inlet port 60 and outlet port 62, or the pluralities of inlet and outlet ports 60, 62, are defined within a porting plate or port portion 64 of the end assembly 66. The end assembly 66 includes a fluid inlet 30 that is in communication with the inlet port 60 and a fluid outlet 34 that is in communication with the outlet port 62. The fluid inlet 30 and fluid outlet 34 are typically positioned at an outer surface 130 of the end assembly 66 for engagement with various components of an external fluid flow path 132. This external fluid flow path 132 can deliver the fluid 28 into the piston pump 10, and also deliver the fluid 28 away from the piston pump 10. Within the end assembly 66, the inlet channel 100 extends between the fluid inlet 30 and the inlet port 60. Similarly, the outlet channel 102 extends between the fluid outlet 34 and the outlet port 62. As discussed above, the inlet channel 100 can also serve to provide a fluid communication between the various inlet ports 60 such that a consistent flow of fluid 28 can be maintained from the fluid inlet 30, through the inlet channel 100, and through the various inlet ports 60 to provide fluid 28 into the eccentric sections 120 of the piston pump 10. Similarly, the outlet channel 102 can extend to multiple outlet ports 62 for delivering the fluid 28 from the various outlet ports 62 to the fluid outlet 34. In this manner, a consistent flow of fluid 28 can be achieved from the narrowed sections 122 of the piston pump 10 and to the fluid outlet 34. The positioning of the inlet ports 60 and the outlet ports 62 can be defined within a flow surface 134 of the end assembly 66. Typically, this flow surface 134 is defined within the port portion 64 of the end assembly 66.

Referring again to FIGS. 4-9, the eccentric portion 50 of the interior cam surface 14 can include first and second eccentric sections 150, 152 that are positioned opposite one another. First and second narrowed sections 154, 156 can also be positioned opposite one another such that the eccentric sections 120 and narrowed sections 122 produce a sequential and alternating pattern of narrowed sections 122 and eccentric sections 120. This alternating pattern of narrowed sections 122 and eccentric sections 120 produces the oscillating motion 52 of the piston members 18 within the piston cavities 20 to produce the expansion and compression of the flow cavities 38. This expansion and compression of the flow cavities 38 produces the suction 26 and pressure 44 that moves the fluid 28 from the fluid inlet 30, through the flow cavities 38 and then to the fluid outlet 34.

In order to achieve a consistent flow of fluid 28 from the fluid inlet 30 and into the various eccentric sections 120, a pressure relief channel 170 can be positioned within the port portion 64. This pressure relief channel 170 can extend between the opposing first and second eccentric sections 150, 152 and serves to equalize the suction 26 between the various eccentric sections 120 within the interior cam surface 14. Using the pressure relief channel 170, a consistent flow of the fluid 28 can be maintained within the interior cam surface 14, and within the various flow cavities 38 defined between the piston members 18 and the piston cavities 20 of the piston pump 10.

In order to remove the fluid 28 from the inlet ports 60 to the flow cavities 38 and from the flow cavities 38 to the outlet ports 62, each piston cavity 20 includes a fluid aperture 110 that extends to a porting surface 180 of the hub 16. Typically, the port portion 64, or porting plate, is positioned adjacent to the hub 16 and the cam member 12. In this configuration, the porting surface 180 of the hub 16 faces the flow surface 134 of the port portion 64. During operation of the hub 16, the fluid apertures 110 of the various piston cavities 20 alternatively align with the inlet ports 60 and outlet ports 62 during operation of the hub 16, in a sequential pattern of alignment. Accordingly, the oscillating motion 52 of the piston members 18 that produces the suction 26 and pressure 44 of the fluid 28 within the piston pump 10 can provide a substantially continuous flow of fluid 28 through the piston pump 10. Through this configuration, operation of the various piston members 18 between the suction phases 40 and pressure phases 42 moves fluid 28 from the inlet port 60, into the flow cavities 38, and then toward the outlet port 62 via the fluid apertures 110 of each piston cavity 20.

As exemplified in the figures, the hub 16 includes six piston cavities 20 and six corresponding piston members 18. Each of these paired piston members 18 and piston cavities 20, during one rotation of the hub 16, experiences multiple oscillations and multiple occurrences of the pressure phases 42 and suction phases 42, 40 of the piston pump 10. Again, rotation of the hub 16 within the interior cam surface 14 produces a consistent, or substantially consistent, flow of the fluid 28 through the eccentric and narrowed sections 120, 122 of the piston pump 10.

Referring again to FIGS. 4-9, within the interior cam surface 14, and the porting plate, two narrowed sections 122 of the interior cam surface 14 correspond to two outlet ports 62 and two eccentric sections 120 of the interior cam surface 14 correspond to two inlet ports 60 of the port portion 64. As discussed above, the two inlet ports 60 are fluidly connected via the inlet channel 100 and the two outlet ports 62 are fluidly connected via the outlet channel 102. Accordingly, multiple inlet ports 60 and multiple outlet ports 62 can be coupled with the fluid inlet 30 and fluid outlet 34, respectively, via a single inlet channel 100 and a single outlet channel 102.

Referring again to FIGS. 1-11, the fluid delivering piston pump 10 includes the end assembly 66 having the fluid inlet 30 and the fluid outlet 34. A fluid path 190 extends between the fluid inlet 30 and the fluid outlet 34. The fluid path 190 also includes various centrifugal sections and centripetal sections that move the fluid 28 through the fluid path 190. The centrifugal sections correspond to the eccentric sections 120, where the centrifugal force 22 generated by rotation of the hub 16 causes the piston member 18 to move outward in an oscillating motion 52. The centripetal sections can correspond to the narrowed sections 122, where the centripetal force 36 generated by the interior cam surface 14 biases the piston members 18 into the corresponding piston cavities 20. As discussed above, these oscillating motions 52 of the piston members 18 produce the suction phases 40 and pressure phases 42 of the piston pump 10.

Referring again to FIGS. 1-11, the hub assembly 196 rotates about the rotational axis 54. The hub assembly 196 includes a plurality of piston members 18 and a central hub 16. Rotation of the hub assembly 196 through the centrifugal sections and the centripetal sections defines a radial movement or oscillating motion 52 of each piston member 18. The piston members 18 that are respectively positioned within corresponding piston cavities 20 define flow cavities 38 therebetween. Rotation of the hub 16 generates the centrifugal force 22 that biases the piston members 18 toward the interior cam surface 14 and away from the rotational axis 54 of the hub 16. At the same time, the interior cam surface 14 produces a centrifugal force 22 that maintains an outward position of each of the piston members 18. This outward position of the piston members 18 is consistent with the shape or profile of the interior cam surface 14 within which the hub assembly 196 rotates.

The plurality of piston members 18 operating in the radial outward direction 24 and within the centrifugal sections serves to expand the corresponding flow cavities 38 that generates a suction 26 for drawing the fluid 28 from the inlet port 60. The plurality of piston members 18 operating in a radial inward direction occurs within the centripetal sections and operates to compress the flow cavities 38. This compression of the flow cavities 38 generates a pressure 44 that pushes the fluid 28 out of the flow cavities 38 and toward the outlet port 62. As discussed herein, the centrifugal sections and the centripetal sections sequentially define the suction phases 40 and pressure phases 42, respectively, of the piston members 18. Operation of the piston members 18 between the suction phases 40 and pressure phases 42 serve to move the fluid 28 from the inlet port 60, into the flow cavities 38 and then toward the outlet port 62.

Using the piston pump 10, fluids of various viscosities, as well as fluids 28 of changing viscosities, can be moved from the fluid inlet 30, through the flow cavities 38, and then to the fluid outlet 34. As discussed above, in certain conditions, the viscosity of a fluid 28 may change over time to be less or more viscous. The operation of the ball piston pump 10 is able to accommodate these changing viscosities and fluctuating viscosities during operation of a particular device that requires a flow of fluid 28 running therethrough.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A fluid pump comprising:

a cam plate that defines an interior cam surface having an eccentric portion and a narrowed portion;

an end assembly that includes an inlet channel and an outlet channel;

a hub that rotates within the interior cam surface and having a piston cavity that is in communication with an inlet port and an outlet port and in communications with the inlet channel and the outlet channel; and a piston member that is operably received within the piston cavity to define a suction phase within the eccentric portion and a pressure phase within the narrowed portion, wherein the piston member is biased outward by rotational operation of the hub, wherein:

during the suction phase, the piston member is biased away from the piston cavity to define a flow cavity that draws fluid from the inlet port;

during the pressure phase, the piston member is biased by the narrowed portion into the flow cavity to push the fluid from the flow cavity toward the outlet port;

the eccentric portion includes opposing first and second eccentric sections of the interior cam surface and the narrowed portion includes opposing first and second narrowed sections of the interior cam surface; and the cam plate at least partially defines a pressure relief channel that extends between the opposing first and second eccentric sections and that serves to equalize a suction between the opposing first and second eccentric sections.

2. The fluid pump of claim 1, wherein the inlet port and the outlet port are defined within the end assembly.

3. The fluid pump of claim 2, wherein the end assembly has a fluid inlet that is in communication with the inlet port and a fluid outlet in communication with the outlet port, and wherein:

the fluid inlet and the fluid outlet are positioned at an outer surface of the end assembly;

the inlet port and the outlet port are defined within a flow surface of the end assembly;

the inlet channel extends between the fluid inlet and the inlet port and the outlet channel extends between the fluid outlet and the outlet port; and the end assembly includes a porting plate that is positioned between the cam plate and an end plate of the end assembly, the porting plate having the inlet port that extends between the eccentric portion and the inlet channel, and the outlet port extends between the narrowed portion and the outlet channel.

4. The fluid pump of claim 1, wherein the piston member is biased against the interior cam surface at least by a centrifugal force generated during rotation of the hub.

5. The fluid pump of claim 3, wherein each piston cavity includes a fluid aperture that extends to a porting surface of the hub, wherein the fluid apertures alternatively align with the inlet channel and the outlet channel during operation of the hub, wherein operation of the piston member between the suction phase and the pressure phase moves the fluid from the inlet port, into the piston cavities and toward the outlet port.

6. A fluid pump comprising:

a cam plate having an interior cam surface that defines alternating eccentric and narrowed sections;

an end assembly that includes an inlet channel and an outlet channel;

a hub that rotates within the interior cam surface and having piston cavities in communication with an inlet port and an outlet port and in communication with the inlet channel and the outlet channel; and piston members that are respectively positioned within the piston cavities to define flow cavities therebetween, wherein rotation of the hub generates a centrifugal force that biases the piston members toward the interior cam surface and away from a rotational axis of the hub, the interior cam surface including a generally elliptical profile having two eccentric sections and two narrowed sections, wherein:

the alternating eccentric and narrowed sections define a suction phase and a pressure phase, respectively, of each piston member;

each suction phase biases the piston members outward to expand the flow cavity, the suction phases drawing a fluid into the flow cavity from the inlet port;

each pressure phase biases the piston members into the respective piston cavities to compress the flow cavity and expel the fluid from the flow cavity and toward the outlet port;

the inlet port is aligned with the eccentric sections and the outlet port is aligned with the narrowed sections; and a pressure relief channel extends between the two eccentric sections and serves to equalize a suction of the suction phase between the two eccentric sections.

7. The fluid pump of claim 6, wherein:

the two narrowed sections correspond to two outlet ports and the two eccentric sections correspond to two inlet ports; and the two inlet ports are fluidly connected via the inlet channel and the two outlet ports are fluidly connected via the outlet channel.

8. The fluid pump of claim 6, wherein the hub includes six piston cavities and the piston members include six piston members operably positioned within the six piston cavities, wherein each piston member rotationally operates about the rotational axis of the hub and sequentially operates the suction and pressure phases relative to the inlet port and the outlet port.

9. The fluid pump of claim 6, wherein the inlet ports and the outlet ports are defined within a porting plate that is positioned adjacent to the hub and the cam plate.

10. The fluid pump of claim 7, wherein the pressure relief channel is positioned within a porting plate that is positioned adjacent to the hub and the cam plate, wherein the inlet channel and the outlet channel are positioned within an end plate, wherein the porting plate is positioned between the cam plate and the end plate.

11. The fluid pump of claim 7, wherein each piston cavity includes a fluid aperture that extends to a porting surface of the hub, wherein each fluid aperture sequentially aligns with one of the two inlet ports, one of the two outlet ports, the other of the two inlet ports and the other of the two outlet ports.

12. A fluid pump comprising:

an end assembly having a fluid inlet and a fluid outlet, wherein a fluid path extends between the fluid inlet and the fluid outlet, the fluid path having centrifugal sections and centripetal sections that move fluid through the fluid path;

a cam plate having an interior cam surface that defines the centrifugal sections and the centripetal sections; and a hub assembly that rotates about a rotational axis, the hub assembly comprising a plurality of piston members and a central hub, wherein, rotation of the hub assembly through the centrifugal sections and the centripetal sections defines a radial movement of each piston member of the plurality of piston members;

the plurality of piston members operating in a radially outward direction in the centrifugal sections to expand corresponding flow cavities that draw the fluid from an inlet port;

the plurality of piston members operating in a radially inward direction in the centripetal sections to compress the corresponding flow cavities and push the fluid out of the corresponding flow cavities and toward an outlet port; and the end assembly includes a pressure relief channel that extends between the centrifugal sections and equalizes a suction within the corresponding flow cavities to draw the fluid from the inlet port.

13. The fluid pump of claim 12, wherein the end assembly includes an end plate and a porting plate, wherein the inlet port and the outlet port are defined within the porting plate that is positioned adjacent the cam plate and the hub assembly, wherein:

the end plate has as inlet channel in communication with the inlet port and an outlet channel in communication with the outlet port;

the fluid inlet and the fluid outlet are positioned at an outer surface of the end plate; and the inlet channel and the outlet channel extend to a flow surface of the end plate, wherein the porting plate engages the flow surface.

14. The fluid pump of claim 12, wherein the inlet port extends through an inlet channel to the fluid inlet and the outlet port extends through an outlet channel to the fluid outlet.

15. The fluid pump of claim 12, wherein the plurality of piston members are operably disposed within respective piston cavities of the central hub, wherein the respective piston cavities guide operation of the plurality of piston members in the radially outward and radially inward directions during rotational operation of the central hub.

16. The fluid pump of claim 12, wherein the flow cavities are defined between the plurality of piston members and the respective piston cavities.

17. The fluid pump of claim 12, wherein each respective piston cavity includes a fluid aperture that extends to a porting surface of the hub assembly, wherein operation of the hub assembly sequentially aligns the fluid apertures with the inlet ports and the outlet ports.

18. The fluid pump of claim 12, wherein the plurality of piston members are biased into an elliptical motion around a rotational axis of the hub assembly, wherein the elliptical motion is defined by a centrifugal force generated during rotation of the central hub and a centripetal force exerted by the interior cam surface.

19. The fluid pump of claim 12, wherein the centrifugal sections and the centripetal sections sequentially define a suction phase and a pressure phase, respectively, of the plurality of piston members, wherein operation of the plurality of piston members between the suction phase and the pressure phase moves the fluid from the inlet port, into the flow cavities and toward the outlet port.

20. The fluid pump of claim 12, wherein the pressure relief channel is at least partially defined by the cam plate.

* * * * *